US008191390B2

(12) United States Patent
Graf et al.

(10) Patent No.: US 8,191,390 B2
(45) Date of Patent: Jun. 5, 2012

(54) RADIAL ROLLER HEAD

(75) Inventors: Jakob Graf, Alveslohe (DE); Dirk Marbs, Schwarzenbek (DE); Roland Woehl, Worth (DE); Detlef Adam, Luetau (DE)

(73) Assignee: Fette GmbH (DE)

( * ) Notice: Subject to any disclaimer, the term of this patent is extended or adjusted under 35 U.S.C. 154(b) by 1006 days.

(21) Appl. No.: 12/167,635

(22) Filed: Jul. 3, 2008

(65) Prior Publication Data

US 2009/0025443 A1 Jan. 29, 2009

(30) Foreign Application Priority Data

Jul. 7, 2007 (DE) ..... 10 2007 031 753

(51) Int. Cl.
*B21D 3/02* (2006.01)
*B21H 3/02* (2006.01)

(52) U.S. Cl. ..... 72/121; 72/108

(58) Field of Classification Search ..... 72/14.2, 72/102, 104, 108, 121, 430; 470/66, 70
See application file for complete search history.

(56) References Cited

U.S. PATENT DOCUMENTS 5,924,317 A * 7/1999 Buck ..... 72/121
2004/0231380 A1* 11/2004 Hofmann et al. ..... 72/108

FOREIGN PATENT DOCUMENTS

DE 24 41 387 3/1976
DE 42 36 085 4/1994
EP 0 853 991 7/1998

* cited by examiner

*Primary Examiner* — Teresa Ekiert

(74) *Attorney, Agent, or Firm* — Hiscock & Barclay, LLP

(57) ABSTRACT

Radial roller head with rollers distributively arranged in a holder under the same angular separations and in axial separations around a roller axis, the roller surfaces of which have an increasing progression in a spiral manner around the circumference in the counter clockwise direction. A gear wheel drive couples the rollers together. A locking device automatically locks into place after each full roller rotation and is released before each roller procedure via a moveable locking element. A drive device turns the rollers after release of the locking device up to the contact of the roller surfaces with a tool, in order to then be further turned through friction therewith. An electromagnet connected with the locking element, is arranged in the radial roller head with an electrical energy source and a switch connecting the energy source with the electromagnets when the switch is actuated via the work piece or another actuating device.

10 Claims, 4 Drawing Sheets

RADIAL ROLLER HEAD

The subject patent application is based upon German Patent Application No. 10 2007 031 753.2-14 entitled: RADIAL ROLLER HEAD, filed Jul. 7, 2007, the entire contents of which is incorporated herein by reference.

FIELD OF THE INVENTION

The invention relates to a radial roller head.

BACKGROUND OF THE INVENTION

Radial roller heads became known, for example, from DE 24 41 387 A1, DE 42 36 085 A1 or also EP 0 853 991 B1. The radial roller heads have in common that rollers are arranged in a distributed manner around the roller axis in a holder under the same angle and axis-center distances. The roller surfaces have a spiral rising progression around the perimeter in a counter-clockwise manner. The rollers are coupled with a gear-wheel drive, and a locking device automatically engages after each full roller rotation. The locking device is triggered before the roller procedure and namely by the work piece that is to be formed with the roller or also by an actuating lever. The rollers are driven with the help of several tension springs, which engage eccentrically on a disk. The disk is connected in a torque-proof manner with a cam plate, which in turn works together with a locking element. During the rotation of the rollers through contact with the work piece, the springs are tensioned and locked in their tensioned position through contact of the locking element with the cam plate. Only after the release of the locking device does a partial rotation of the rollers take place from a position, in which the work piece can be readily inserted axially between the rollers, to a position in contact with the work piece.

An automatic release of the locking device became known from the named EP 0 853 991 B1 in which the work piece hits a pin and the unlocking is thereby set in motion. The mechanism required for this is relatively complicated.

SUMMARY OF THE INVENTION

The object of the invention is to create a radial roller head, the locking device of which is structured in a simpler manner and enables a simple drive mechanism.

In the case of the invention, an electromagnet that is coupled with the locking element is arranged in the radial roller head. An electrical energy source and a switch are also arranged in the radial roller head. The switch connects the electromagnets with the energy source if it is actuated via the work piece or another actuating device. Thus, with the help of the electromagnets, the locking element can be disengaged from the locking device so that the drive device can start the rotation of the rollers.

According to one embodiment of the invention, it is provided that the radial roller head has a battery and a capacitor connected to the battery. The capacitor can store and deliver the energy to be applied for a short period of time for the actuation of the electromagnets.

In the case of a further embodiment according to the invention, it is provided that the switch can be actuated by an actuating lever that is swivel-mounted in the radial roller head, one end of which projects outward over the perimeter of the radial roller head. This type of lever is generally known in the state of the art. There, it is used for the actuation of a locking element.

In a further embodiment of the invention, it is provided that the drive device affects a drive shaft and the drive shaft has an axial bore hole, in which a pin is incorporated in a moveable manner, the front end of which protrudes over the drive shaft and which is coupled with a switch in the shaft. If the work piece moves back against the pin, the switch is actuated and it triggers the actuation of the locking element.

In another embodiment of the invention, it is provided that the locking element is a locking lever swivel-mounted in the radial roller head, with which the electromagnet engages. The locking lever is preloaded and lies against a helical radial cam with an axial shoulder, which is connected with a drive shaft connected with the drive device. The locking lever rests against the shoulder of the radial cam in the initial position and is lifted over the shoulder with the help of the electromagnet so that a relative turning can take place between the radial cam and the locking level in order to drive the rollers.

The radial cam is preferably formed on one side of a plate, which is connected in a torque-proof manner with the drive shaft. According to a further embodiment of the invention, the locking lever can overlap the plate in a fork-like manner on the perimeter.

According to another embodiment of the invention, a sensor that determines the actuation of the locking element works together with the locking element. A determination of the unlocking can for example be displayed outwards by a diode or suchlike so that the operator knows that a roller procedure has been triggered.

It is provided in a further embodiment of the invention that a second circumferential radial cam, against which lies a spring preloaded cam follower, is connected with a drive shaft that is connected with the drive device. The second radial cam is designed such that its radial extension in the locked state of the locking device has a maximum and becomes continuously smaller in the circumferential direction up to a minimum radius and then increases again to the maximum. A drive device for the drive shaft, which is structured in an extraordinarily simple manner, is created with the help of the cam follower and the radial cam.

The invention is explained in greater detail according to the accompanying drawings.

DETAILED DESCRIPTION

Figure 1:
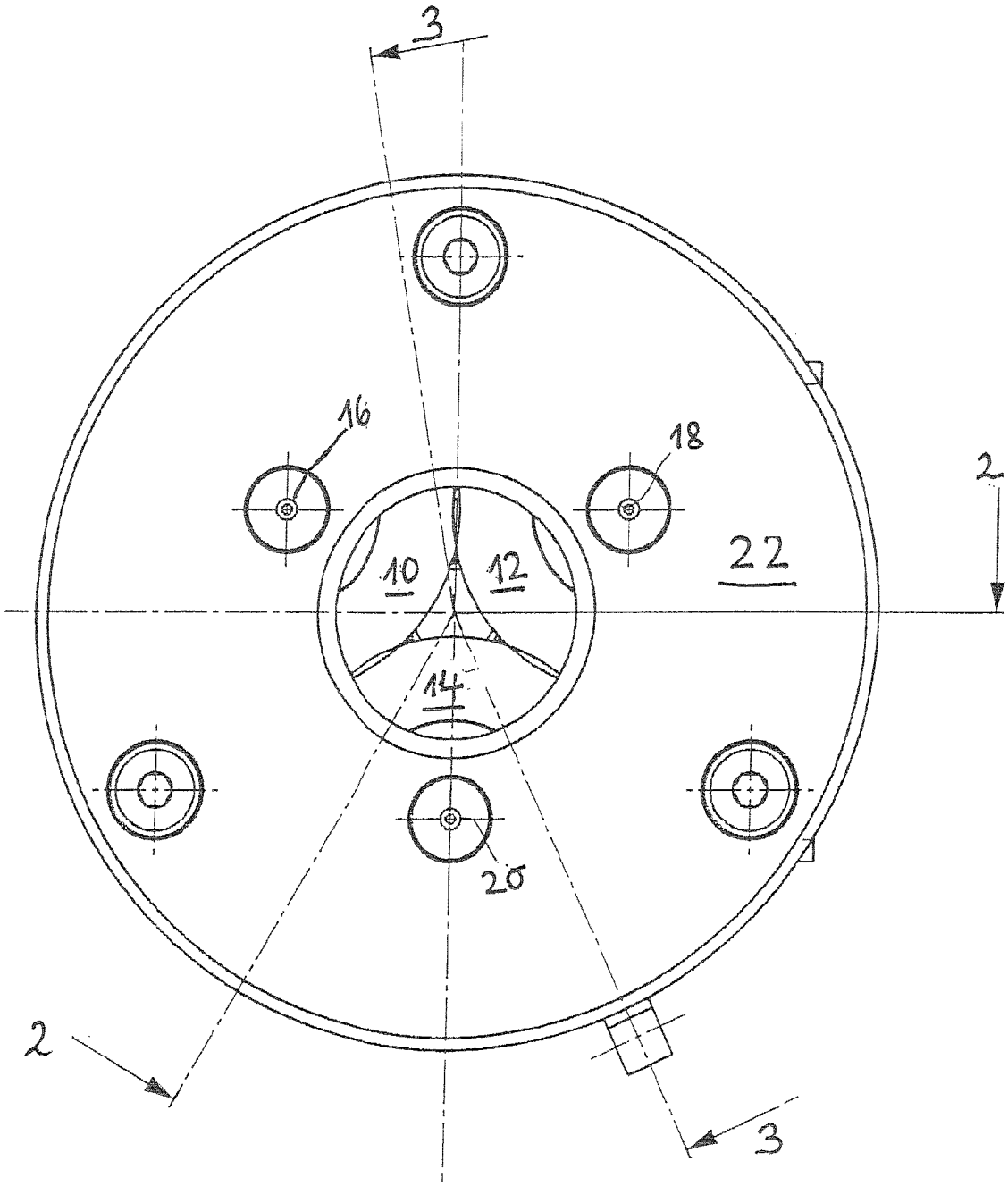
FIG. 1 shows a front view of a radial roller head according to the invention.
Figure 2:
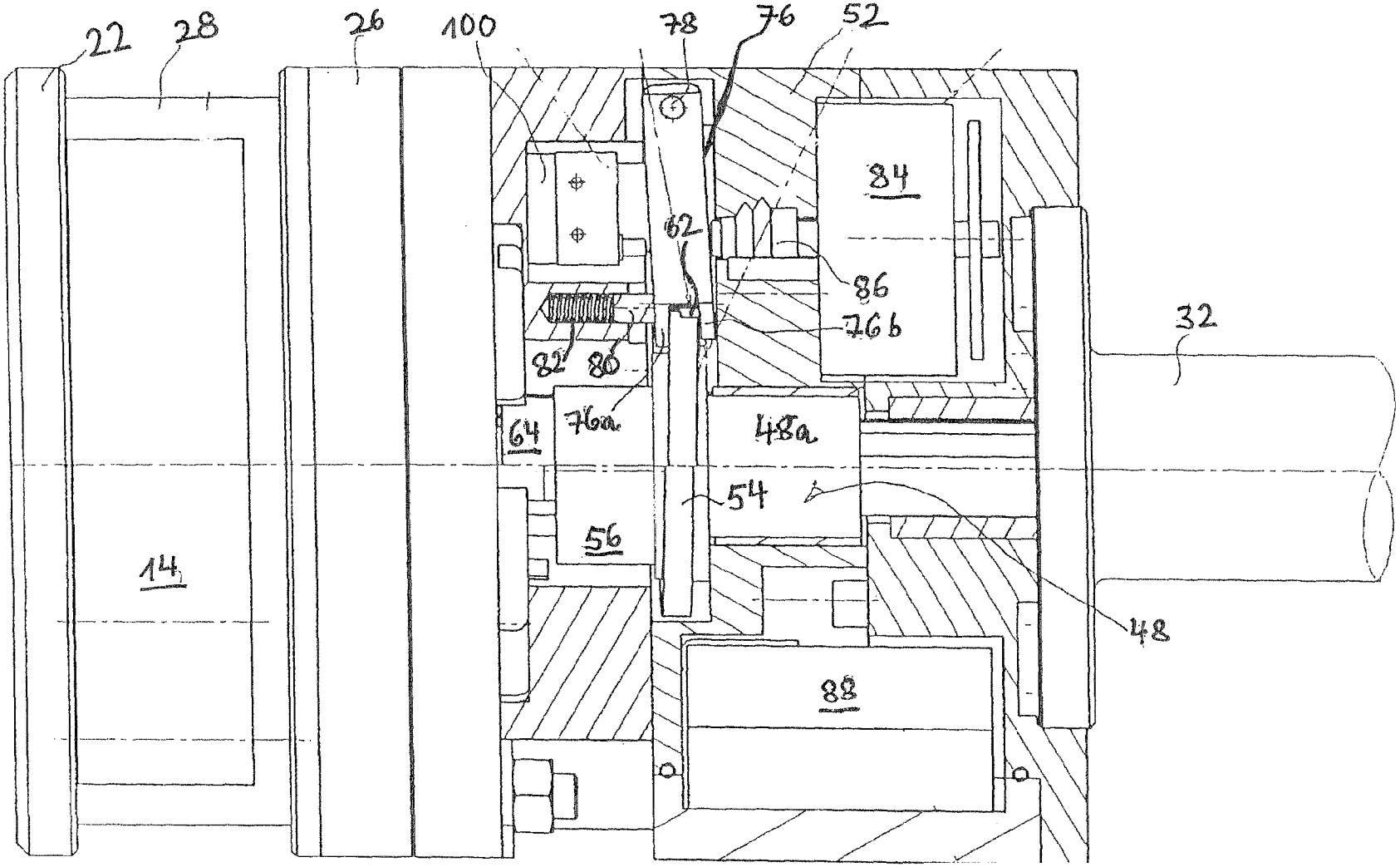
FIG. 2 shows a cut through the radial roller head according to FIG. 1 along line 2-2.
Figure 3:
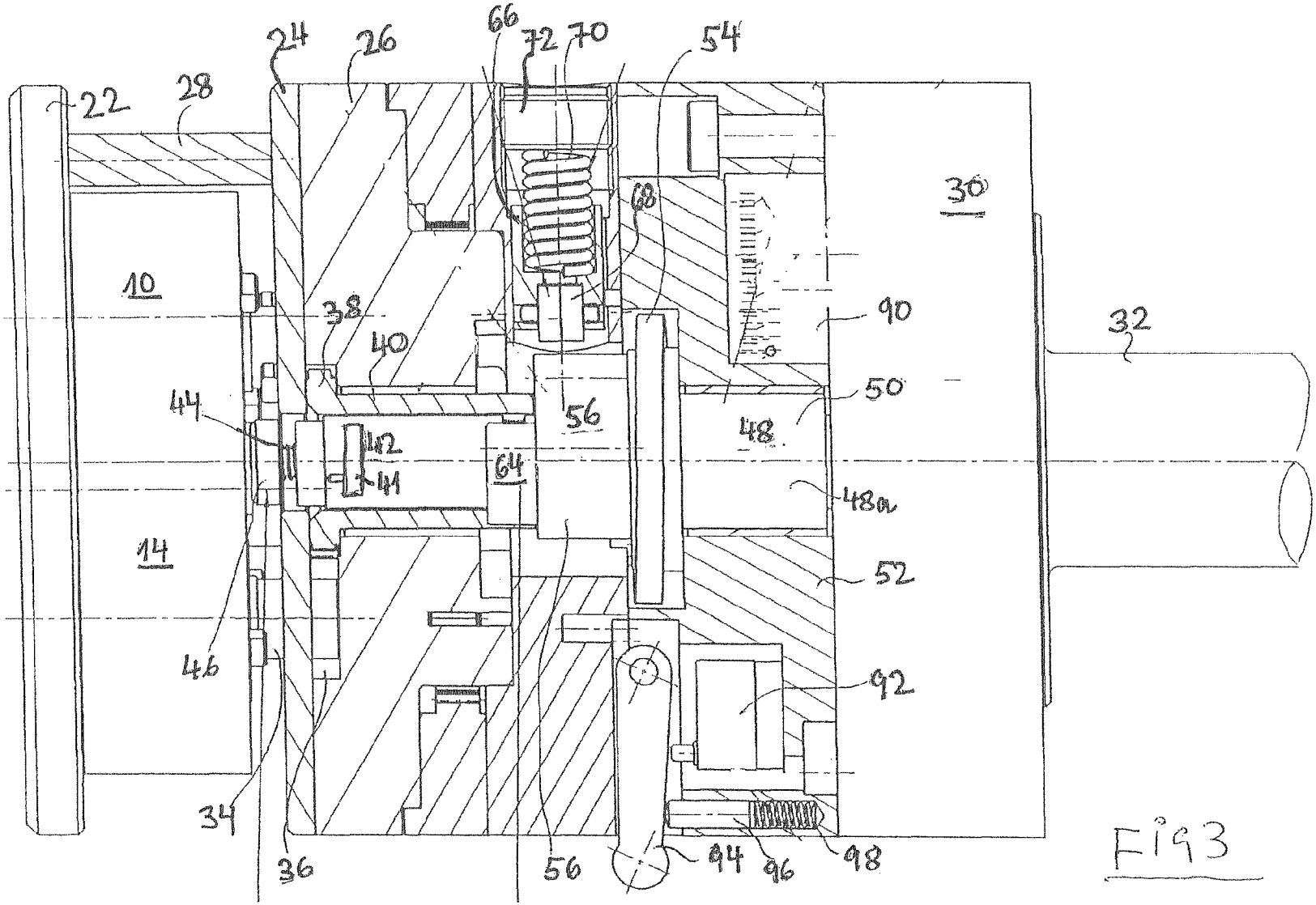
FIG. 3 shows a cut through the radial roller head according to FIG. 1 along line 3-3.

The general structure of the radial roller head shown in the Figures matches that in EP 0 853 991 B1. Three profile rollers are arranged at 10, 12 and 14 in FIG. 1 and are swivel-mounted at 16, 18 and 20, namely on one hand in a front plate 22 and on the other hand in a plate 24 or a plate 26 lying behind this (FIGS. 2 and 3). The profile rollers each have a flat area that is pointed towards the roller axis in the idle position and extends over a circumferential section. Starting from the middle of the flat area, a section of the roller surfaces with an increasing diameter extends over the circumference with a spiral progression. A roller surface lying concentric to the roller axis connects to this at a 90° angle. The remaining 90° angle is used for a sloping part of the roller surface.

The front plate 22 is connected with the plates 24, 26 via suitable spacers 28. These parts can be held together by suitable tensioning screws, which are connected with a holding plate 30. A shaft 32 is connected with the latter plate, via which the radial roller head can be clamped into a machine tool.

FIG. 3 shows how a shaft 34 is mounted in the plates 26 and 24 and carries a gear wheel 36 on its inner end, which meshes with a central intermediate gear wheel 38, which is designed as one piece with a hollow shaft 40.

The hollow shaft 40 is mounted on a bushing 42, which guides a pin 44 axially, which is connected with a stop plate 46. When a work piece is inserted between the rollers 10 through 14, it hits the stop plate 46 and hydraulically actuates a switch 41 in the bushing 42, which will be covered below.

Figure 4:
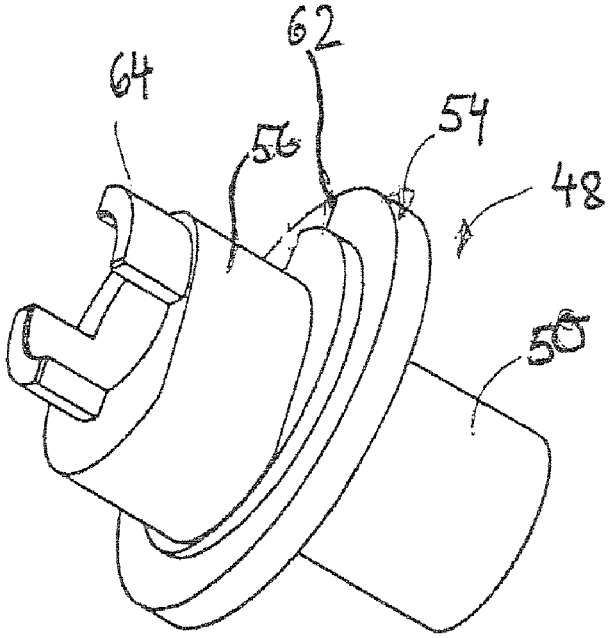
FIG. 4 shows a perspective view of a drive shaft of the radial roller head according to FIGS. 1 through 3.

Reference numeral 48 indicates a drive shaft which has a shaft section 50, which is swivel-mounted in a plate 52 connected with the plate 30 and has a helical disk 54 and a radial cam 56 left of the disk 54. The drive shaft is shown in greater detail in FIG. 4. The disk 54 has the same thickness over the circumference, but is helical, as can be seen in FIG. 2 or 3. It has a radial shoulder 62. The radial cam 56 is rotating and has a minimum radial extension in the upper area and a maximum radial extension in the lower area. A claw section 64 is connected to the control surface 56. The claw section 64 engages into a corresponding claw section on the right end of the hollow shaft 40. If the drive shaft 48 is turned, the hollow shaft 40 also turns and thus the intermediate gear wheel 38. The intermediate gear wheel 38 turns the gear wheels 36 of the individual rollers 10 through 14 until they come in contact with the work piece (this function is described in detail in the already mentioned EP 0 853 991 B1).

A bracket component 66 is mounted in a radially moveable manner in a corresponding cylindrical recess in the radial roller head. It supports a cam roller as a cam follower 68, wherein a screw spring 70 sits in a cylindrical hollow section of the bracket component 66, which is supported on a housing-proof stopper 72. The cam roller is thereby pressed against the perimeter of the radial cam 56.

FIG. 2 shows a locking lever 76, which is fork-like on the inner end and overlaps the disk 54 on the edge. The locking lever 76 is swivel-mounted outwards radially at 78. It is prestressed by means of a pin 80 and a spring 82 in the counter clockwise direction. The left fork arm in FIG. 2 thus comes in contact with the radial cam 60. In the idle position shown in the figures, the left arm thus lies against the stop 62 of the radial cam 60.

An electromagnet 84 is arranged in the plate 52, the actuating element 86 of which can have an effect on the right side of the locking lever 76 in FIG. 2. If the magnet 84 is actuated, the locking lever 76 is pivoted clockwise; the left fork arm in FIG. 2 thus disengages from the shoulder 62 and the disk 54 can be turned. Power is supplied to the electromagnet 84 via a battery 88, which is also housed within the radial roller head. Finally, a relatively large capacitor 90 is also provided (FIG. 3). An electrical switch 92 is actuated either by a lever 94, which projects radially over the outer circumference of the roller head and is swivel-mounted on the inner end. Or the electrical switch 92 is actuated by the stop plate 46, which is not shown in greater detail here. The lever 94 is also prestressed by a pin 96 and a spring 98, namely in a clockwise manner (FIG. 3). Alternatively, the switch 41 can be arranged within the bushing, which is actuated by the stop plate 46.

Figure 5:
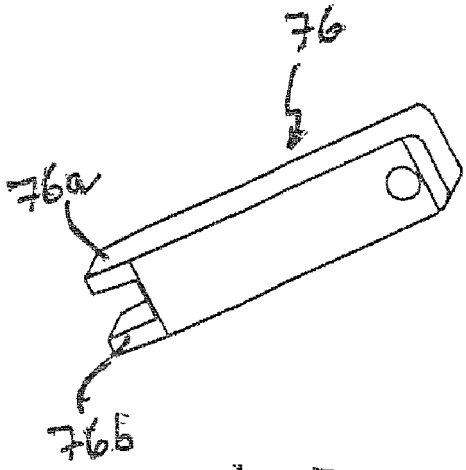
FIG. 5 shows a perspective view of a locking lever of the radial roller head according to FIGS. 1 through 3.

The locking lever 76 shown in FIG. 2 is shown in greater detail in FIG. 5. One can see its fork arms 76*a*, 76*b*, the separation distance of which is minimally larger than the thickness of the disk 54.

In the idle position, the flat areas of the rollers 10 through 14 not shown in the figures are turned towards each other, and the spring 70 is maximally stressed because the cam roller lies against the maximum rise of the radial cam 56. However, this cannot turn the shaft 48 because it is prevented by the stop of the fork arm 76*a* on the shoulder 62 of the disk 54. If the switch 92 is now actuated via the work piece or the lever 94, the electromagnet 84 moves the locking lever 76 into the unlocked position. The spring 70 can henceforth turn via the drive shaft 48 until the profiles of the profile rollers 10 through 14 come in contact with the work piece. The rollers 10 through 14 are turned based on the roller procedure, wherein they take along the gear wheel 38, the hollow shaft 40 and the drive shaft 48. The fork arm 76*a* thereby wanders along the disk and is moved according to the slope of its coil. The spring 70 is re-tensioned via the cam roller. The turning ends when the fork arms 76*a*, 76*b* snap behind the shoulder 62. The drive shaft 48 is thus locked. The described procedure is repeated when a new work piece is provided with a profile in the described manner.

A sensor 100, which is actuated when the locking lever 76 is moved to the unlocked position, is arranged on the left side of the locking lever 76 in FIG. 2. It can thereby be determined whether the radial roller head was triggered.

The invention claimed is:

1. A radial roller head with rollers distributively arranged in a holder under the same angular separations and in axial separations around a roller axis, the roller surfaces of which have an increasing progression in a spiral manner around the circumference in the counter clockwise direction;

a gear wheel drive coupling the rollers together;

a locking device for the rollers, said locking device automatically locking into place after each full roller rotation and releasable before each roller procedure via a movable locking element;

a drive device, which turns the rollers after the release of the locking device up to the contact of the roller surfaces with a tool, in order to then be further turned through friction therewith;

an electromagnet arranged in the radial roller head, said electromagnet being connected with the locking element; and an electrical energy source and a switch, each arranged in the radial roller head, which connects the energy source with said electromagnet when the switch is actuated via a work piece or another actuating device.

2. Radial roller head according to claim 1, wherein the energy source is a battery, said roller head further including a capacitor connected to the battery and arranged in the radial roller head.

3. Radial roller head according to claim 1, wherein the switch is actuated by an actuating lever that is swivel-mounted in the radial roller head, wherein one end of said actuating lever projects outward over the perimeter of the radial roller head.

4. Radial roller head according to claim 1, wherein the drive device affects a drive shaft, said drive shaft having a pin in an axial bore hole, which protrudes over the front end of the drive shaft and is coupled with the switch.

5. Radial roller head according to claim 1, wherein the locking element is a locking lever swivel-mounted in the radial roller head, with which the electromagnet engages, the locking lever under spring preloading working together with a first helical radial cam with an axial shoulder, which is connected with the drive shaft connected with the drive device, wherein the locking lever lies against the shoulder before the release of the locking device.

6. Radial roller head according to claim 5, wherein the first radial cam is formed on a helical disk.

7. Radial roller head according to claim 6, wherein the locking lever overlaps the disk around the perimeter, said locking lever including fork arms that overlap on opposing sides of said disk.

8. Radial roller head according to claim 5, further comprising a second circumferential radial cam, against which a cam follower is spring preloaded, said second circumferential radial cam being connected with a drive shaft that is connected with the drive device, said second circumferential radial cam being designed to have a maximum radial extension in the locked state of the locking device that becomes continuously smaller in the circumferential direction up to a minimum radius and then increases again to the maximum radial extension.

9. Radial roller head according to claim 1, wherein a sensor determines the actuation of the locking element, said sensor working together with the locking element.

10. Radial roller head according to claim 1, further comprising a circumferential radial cam, against which a cam follower is spring preloaded, said circumferential radial cam being connected with a drive shaft that is connected with the drive device, said circumferential radial cam being designed to have a maximum radial extension in the locked state of the locking device that becomes continuously smaller in the circumferential direction up to a minimum radius and then increases again to said maximum radial extension.

* * * * *